US008439281B2

(12) United States Patent
Troudt

(10) Patent No.: US 8,439,281 B2
(45) Date of Patent: May 14, 2013

(54) MODULAR COATINGS SPRAYER

(75) Inventor: Kevin Troudt, Roswell, GA (US)

(73) Assignee: Hyde Tools, Inc., Southbridge, MA (US)

( * ) Notice: Subject to any disclaimer, the term of this patent is extended or adjusted under 35 U.S.C. 154(b) by 644 days.

(21) Appl. No.: 12/583,187

(22) Filed: Aug. 14, 2009

(65) Prior Publication Data

US 2010/0084493 A1 Apr. 8, 2010

Related U.S. Application Data

(60) Provisional application No. 61/189,132, filed on Aug. 15, 2008.

(51) Int. Cl.
*B05B 9/01* (2006.01)

(52) U.S. Cl.
USPC ..... 239/526; 239/583; 251/229; 251/237

(58) Field of Classification Search ..... 239/345, 239/526, 600, 691, 527, 528, 583; 251/229, 251/237
See application file for complete search history.

(56) References Cited

U.S. PATENT DOCUMENTS

| | | | | |
|---|---|---|---|---|
| 2,705,663 | A | 4/1955 | Gilbreath | |
| 2,991,940 | A | 7/1961 | Dupler et. al. | |
| 4,013,225 | A | 3/1977 | Davis | |
| 4,457,472 | A * | 7/1984 | Geberth, Jr. | 239/532 |
| 5,118,080 | A * | 6/1992 | Hartmann | 251/229 |
| 5,772,116 | A | 6/1998 | Holt | |
| 6,460,787 | B1 * | 10/2002 | Hartle et al. | 239/691 |
| 7,032,839 | B2 * | 4/2006 | Blette et al. | 239/302 |
| 7,246,759 | B2 * | 7/2007 | Turnbull | 239/525 |
| 7,364,098 | B2 | 4/2008 | Alexander et al. | |
| 7,922,107 | B2 * | 4/2011 | Fox | 239/600 |

* cited by examiner

*Primary Examiner* — Dinh Q Nguyen
(74) *Attorney, Agent, or Firm* — Louis J. Franco; Law Office of Louis J. Franco

(57) ABSTRACT

A modular coatings sprayer includes a valve housing in which there is defined a nozzle orifice and a valve-shaft bore opposite the nozzle orifice. A housing side wall extends between the orifice and bore and defines an internal fluid passage. The side wall includes an opening through which pressurized fluid is introduced into the fluid passage. A valve including a valve shaft with opposed back and nozzle-closing ends is sealably supported within the bore such that (i) the nozzle-closing end is situated within the housing and the back end is situated external to the housing and (ii) the valve shaft can axially reciprocated between a first position in which the nozzle-closing end does not seal the nozzle orifice and a nozzle-closing position in which the nozzle-closing end seals the nozzle orifice such that pressurized fluid within the fluid passage is prevented from exiting through the nozzle orifice. The valve housing is configured for selective cooperative coupling to a valve-actuating assembly having a body and a lever mounted for pivotable movement relative to the body. The lever selectively engages a portion of the valve shaft external to the valve housing such that (i) when the lever is pivoted in a first direction, the valve shaft is axially displaced in order to open the nozzle orifice and (ii) when the lever is pivoted in a second direction, the valve shaft is axially displaced toward the nozzle-closing position.

17 Claims, 7 Drawing Sheets

MODULAR COATINGS SPRAYER

PROVISIONAL PRIORITY CLAIM

Priority based on Provisional Application Ser. No. 61/189,132 filed Aug. 15, 2008, and entitled "MODULAR COATINGS SPRAYER" is claimed. The entirety of the disclosure of the previous provisional application, including the drawings, is incorporated herein by reference as if set forth fully in the present application.

BACKGROUND

Embodiments of the present invention relate to coatings sprayers and, in various more particular aspects, to paint sprayers. A typical paint sprayer includes a handheld spray gun with a spring-loaded trigger that is actuated by 2 or 3 fingers. The trigger selectively opens a valve to spray pressurized paint through a nozzle. In order to facilitate access to "overhead" spray targets, some manufactures produce and market elongated spray guns. An elongated spray gun includes, for example, a handheld trigger body from which extends an elongated rigid paint conduit with longitudinally opposed proximate and distal conduit ends. The distal end of the conduit includes a nozzled tip through which paint is ejected when the user squeezes the trigger near the proximate end of the conduit.

A second type of painting product, referred to for purposes of description as a "triggered extension pole," includes a rigid pole with proximate and distal ends. The distal end of the pole includes mechanisms for selectively retaining a spray gun originally designed to be held in a user's hand, while the proximate end of the pole includes a trigger that, when actuated, actuates a linkage connected to a mechanism(s) that pulls on the trigger of the handheld sprayer, thereby facilitating remote (e.g., overhead) actuation of the handheld sprayer.

Each of the known apparatus described above is accompanied by advantages and disadvantages. For example, unless a user of an elongated sprayer has two separate paint-supply lines (e.g., hoses)—one for a handheld sprayer and the other for the elongated sprayer—he or she must depressurize the paint supply line in order to change from one sprayer to the other. Depressurizing and switching sprayers is inconvenient, messy and, worse, may result in discontinuity in the appearance of the painted surface. A triggered extension pole obviates the depressurization issue because a user can alternatively insert into and remove from the retaining mechanisms at the distal end of the pole a handheld spray gun. However, depending on the length of the pole, the angle of spray, and the distance between the user and the targeted surface, the use of a triggered extension pole can be awkward and tiresome, facts that can fatigue the user and impact the quality of work.

Accordingly, a need exists for paint spraying apparatus that provide the balance and ease of use of an elongated spray gun, while obviating the inconvenience and mess associated with depressurizing a paint supply line and switching spray guns during the course of a single painting project.

SUMMARY

In accordance with a first illustrative embodiment, a modular coatings sprayer is in the form of a hand-held spray gun configured for applying to surfaces liquid coatings such as paint and lacquer. The spray gun comprises a valve housing and a trigger body that are selectively coupleable to, and separable from, one another. The valve housing has a front end in which there is defined a nozzle orifice, a rear end opposite the front end through which there is defined a valve-shaft bore for accommodating a valve shaft, a housing side wall extending between the front and rear ends and defining a central, internal fluid passage, and a fluid-supply opening in the housing side wall.

Supported by the valve housing is a valve having an elongated valve shaft with a back end and a nozzle-closing front end opposite the back end. The valve shaft extends along a valve-shaft axis through the valve-shaft bore. The valve shaft is sealably supported within the valve-shaft bore and retained thereby for fluid-tight axial reciprocation with respect to the valve housing such that the nozzle-closing end is situated within the internal fluid passage and the back end is situated rearwardly of the rear end of the valve housing. The seal between the valve shaft and the portion of the valve housing defining the valve-shaft bore may be accomplished by a packing gland, a device known to those of ordinary skill in the art to which the present invention pertains. The valve shaft is normally biased toward a nozzle-closing position in which the nozzle-closing end seals the nozzle orifice such that fluid introduced through the fluid-supply opening into the fluid passage is prevented from exiting through the nozzle orifice. The valve shaft is biased forwardly toward the nozzle-closing position by a biasing element such as, by way of non-limiting example, a coiled spring retained within the valve housing and helically disposed about a portion of the valve shaft. The nozzle-closing end of the valve shaft can be alternatively configured. In one version, the valve is a needle valve with a pointed nozzle-closing end that directly plugs the nozzle orifice. In an alternative version, the nozzle-closing end of the valve shaft urges a separate orifice-sealing element (e.g. a ball) against the portion of the valve housing defining the nozzle orifice in order to close the orifice.

In one embodiment, the trigger body comprises a handle configured for grasping by a human hand. The handle is typically of the pistol-grip type well known to painters and designers of spray-painting implements. A barrel depends forwardly from the handle and includes a housing-retaining bore that is configured for selectively receiving and retaining a rearward housing portion that extends along a portion of the length of the valve housing including the rear end of the valve housing. In one version, the housing-retaining bore and the rearward housing portion are cylindrical in cross-section; however, it is to be understood that, absent an express limitation to the contrary, the invention as defined in the appended claims is not so limited. In some versions, the barrel or the rearward housing portion carries a catch spring-loaded for mechanical bias into a catch-receiving recess in the other of the barrel and rearward housing portion. In one example, the barrel carriers a spring-loaded ball biased inwardly toward the housing-retaining bore and the outer surface of the rearward housing portion has defined therein a recess for receiving a portion of the spring-loaded ball catch. In still additional versions, the recess is an endless annular recess disposed about the outer surface of the rearward housing portion such that, when the rearward housing portion is retained within the barrel, the valve housing can be rotated with respect to the trigger body. It will be appreciated that retention of the valve housing could alternatively by achieved by a set screw, but the mechanisms described above render coupling and decoupling tool-less.

The trigger body furthermore carries a trigger. The trigger is disposed forwardly of the handle and retained for pivotable movement, relative to the handle, by a trigger-pivot pin. The trigger includes a lower trigger end and an upper trigger end defining a yoke with transversely spaced apart first and second yoke fingers. The pivot pin retains the trigger by passing through the trigger body and each of the yoke fingers. The trigger further includes a finger-engaging trigger surface configured for engagement by human fingers and extending transversely between the yoke fingers. Defined through the finger-engaging surface is a valve-shaft notch that communicates with the space between the yoke fingers, extends toward the lower trigger end, and is narrower than the distance between the yoke fingers.

The trigger-pivot pin is retained within an elongated pin slot defined in the trigger body in order to facilitate selective lineal displacement of the pin and trigger, along, but not necessarily parallel to, an axis orthogonal to the valve-shaft axis, between upper and lower trigger positions. That is, the pin and trigger can be selectively displaced along a lineal path having at least one component of spatial extension that is perpendicular to the valve-shaft axis. The upper position is defined such that, when the valve housing is cooperatively coupled with the trigger body (i.e., the rearward housing portion is retained by the barrel), the valve shaft extends through the valve-shaft notch such that the back end of the valve shaft is situated behind the trigger. A portion of the length of the valve shaft situated behind the trigger is of enlarged cross section relative to the portion of the length of the valve shaft passing through the valve-shaft notch. The enlarged valve-shaft portion is sufficiently large along a least one transverse dimension orthogonal to the valve-shaft axis that it cannot pass through the valve-shaft notch in the trigger. In this way, as the trigger is pivoted rearwardly toward the handle by a user's fingers, a rear, valve-engaging surface, opposite the finger-engaging trigger surface, can selectively engage the enlarged valve-shaft portion, and the valve shaft can be pulled rearwardly by the trigger in order to open the nozzle orifice and allow pressurized coating material to be expelled therefrom.

When removal from, or insertion into, the trigger body of a valve housing is desired, the trigger and pin are displaced toward the lower trigger position. The lower trigger position is such that the enlarged valve-shaft portion can clear the trigger, and pass between the yoke fingers unobstructed by trigger material defining the valve-shaft notch, thereby facilitating insertion and removal of the valve housing. However, in an operative mode, the trigger and pin are retained in an upper trigger position. In order to facilitate retention of the trigger and pin in an operative mode, the trigger body carries a cam bolt that is selectively displaceable between a first bolt position and a second bolt position. In various versions, the cam bolt includes a wedge-shaped portion with a sloped pin-engaging surface. The wedge-shaped portion interacts with the trigger-pivot pin such that, as the cam bolt is axially displaced toward the first bolt position, the trigger-pivot pin rides along the sloped pin-engaging surface and the pin and trigger are displaced toward the upper trigger position. Conversely, as the cam bolt is displaced toward the second bolt position, the pin and trigger are free to displace toward the lower trigger position. In order to selectively retain the pin and trigger in the upper trigger position, and the cam bolt in the corresponding first bolt position, the cam bolt includes a pin cradle in which the trigger-pivot pin is seated when the pin and trigger are in an upper trigger position. More specifically, as the cam bolt is displaced toward the first bolt position, the trigger-pivot pin rides along the sloped pin-engaging surface of the cam bolt until it reaches an uppermost position. The pin cradle is situated behind the portion of the pin-engaging surface defining the uppermost trigger position such that, as the cam bolt is displaced all the way into the first bolt position, the pin drops into the pin cradle. The seating of the trigger-pivot pin in the pin cradle acts to prevent unintended displacement of the cam bolt toward the second bolt position, and associated displacement of the trigger and trigger-pivot pin to a lower trigger position. In order to enhance the interactive functionality of the cam bolt and trigger-pivot pin, each of various versions includes a pin-biasing element that normally biases the trigger-pivot pin toward a lower trigger position. Among other functions, the pin-biasing element acts to provide resistance against the movement of the trigger-pivot pin from a seated position in the pin cradle. The pin-biasing element provides a biasing force sufficiently large in magnitude to prevent the unintentional unseating of the pin from the pin cradle in normal use, but sufficiently low in magnitude that the pin can be intentionally unseated by a user's urging of the cam bolt toward the second bolt position. In a typical version, the second bolt position is situated rearwardly of the first bolt position relative to the trigger body.

An alternative embodiment of a modular coatings sprayer includes a valve body and valve such as the valve body and valve described above in connection with an illustrative hand-held version and a pole-mountable actuator head that is selectively cooperatively coupleable to, and decoupleable from, the valve housing for actuating the valve. In an illustrative version, the valve-actuating actuator head has a head housing including front and rear ends and a pole mount by which the heading housing can be secured to the distal end of an extension pole having, in addition to the distal end, a proximal end opposite the distal end and a pivotable trigger mounted more proximate the proximal end than the distal end. A barrel including a housing-retaining channel that is open to the front end of the head housing is configured for selectively receiving and retaining a portion of the length of the valve housing. A valve-shaft lever is mounted within the head housing for pivotable displacement, relative to the head housing, between a forwardmost position and a backward position. The valve-shaft lever includes a valve-engaging surface that selectively engages a portion of the valve shaft external to the valve housing such that a forwardmost position of the valve-shaft lever corresponds to the nozzle-closing position of the valve shaft. The valve-shaft lever is linked to an elongated flexible linkage that enables displacement of the valve-shaft lever toward the backward position, and the corresponding rearward displacement of the valve shaft, in order to open the nozzle orifice. Another portion of the flexible linkage is mechanically linked to the trigger such that, when pivoted, the remotely situated trigger causes the valve shaft to displace away from the nozzle-closing position.

Representative, non-limiting embodiments are more completely described and depicted in the following detailed description and the accompanying drawings.

DETAILED DESCRIPTION

The following description of various embodiments of a modular coatings sprayer system is illustrative in nature and is therefore not intended to limit the scope of the invention or its application of uses. Accordingly, the various implementations, aspects, versions and embodiments described in the summary and detailed description are in the nature of non-limiting examples falling within the scope of the appended claims and do not serve to define the maximum scope of the claims.

Figure 1:
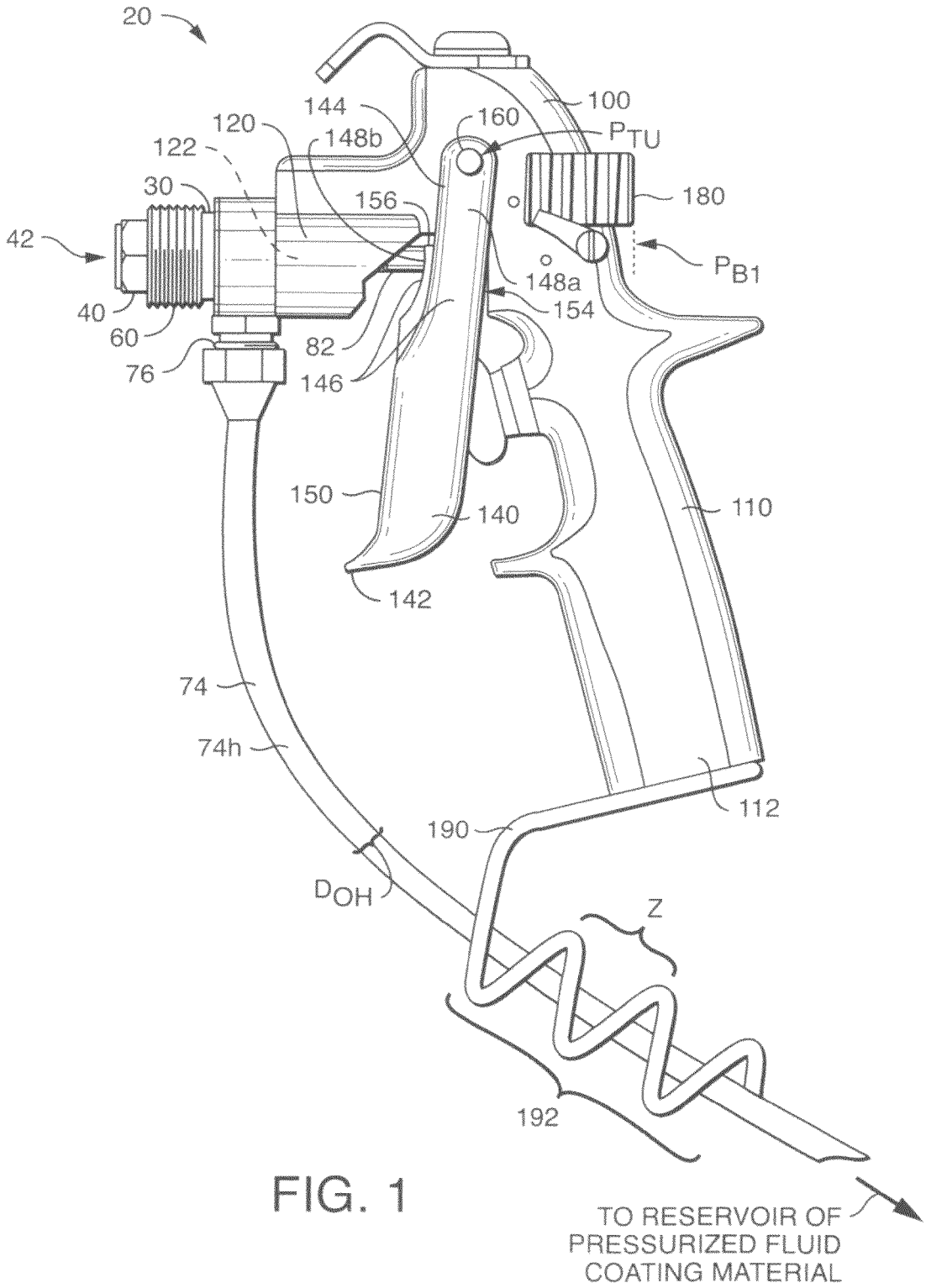
FIG. 1 shows a left-side view of an illustrative coatings sprayer including a hand-held trigger body and a selectively removable valve housing cooperatively coupled with the trigger body and including a valve that can be selectively opened by a trigger on the trigger body.
Figure 2:
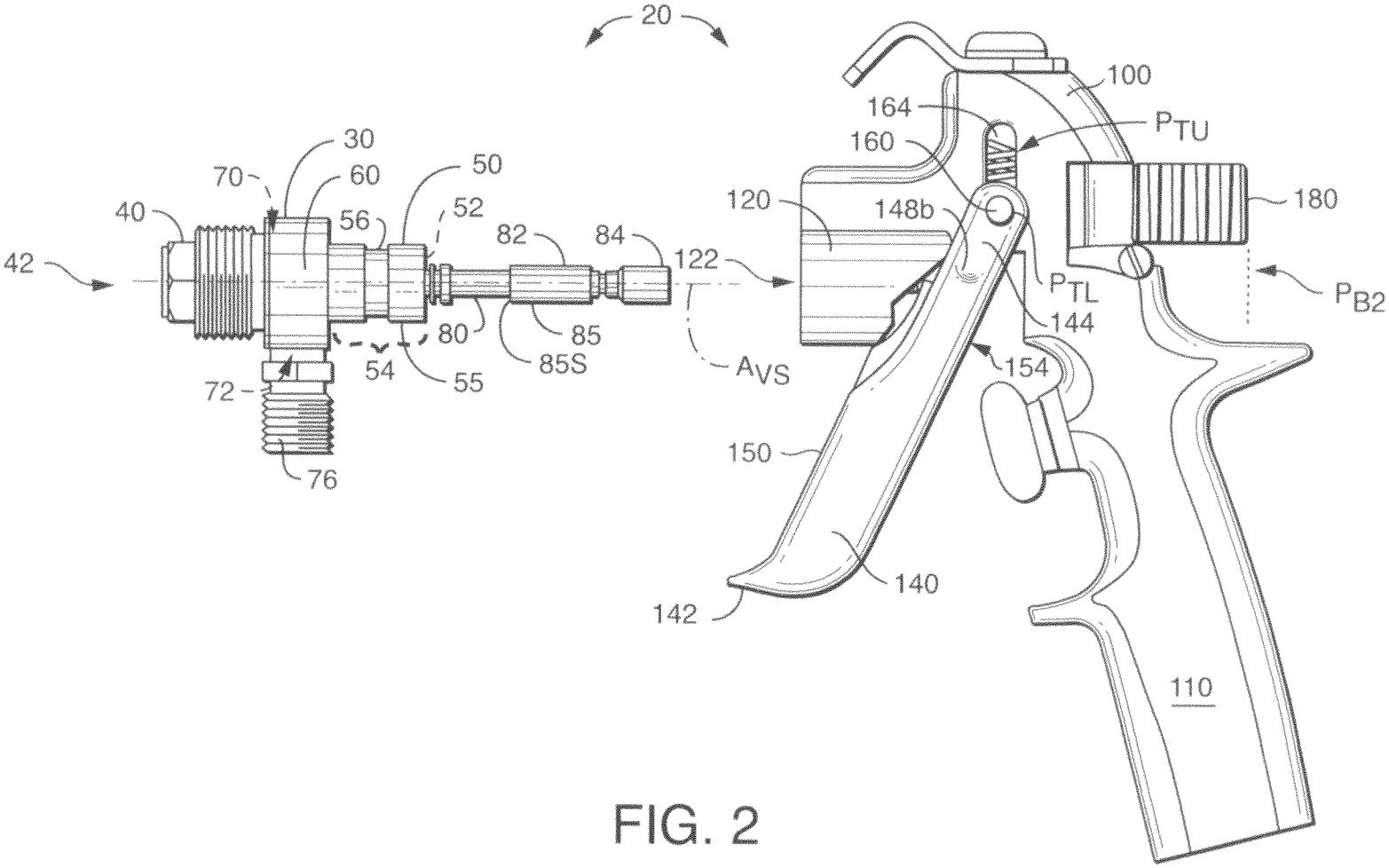
FIG. 2 depicts a left-side view in which the valve housing and trigger body of FIG. 1 are separated (decoupled) from one another.

Referring collectively to FIGS. 1 through 4, a first illustrative embodiment of a modular coatings sprayer is a spray gun 20 configured for dispensing liquid coatings (e.g., paint) including a valve housing 30 and a valve-actuating assembly in the form of a trigger body 100. As shown in FIGS. 1 and 2, the valve housing 30 and trigger body 100 are mutually coupleable and separable. As shown most clearly in FIG. 2, in which the valve housing 30 is separated from the trigger body 100, the valve housing 30 has a front end 40 in which there is defined a nozzle orifice 42, a rear end 50 opposite the front end 40, a housing side wall 60 extending between the front and rear ends 40 and 50 and defining a central, internal fluid passage 70, and a fluid-supply opening 72 in the housing side wall 60. The fluid-supply opening 72 can be selectively coupled with, and decoupled from, a fluid-supply conduit 74, such as the coating-supply hose 74*h* in FIG. 1, linked to a reservoir (not shown) of pressurized fluid coating material (e.g., paint) through a conduit coupling 76. Defined through the rear end 50 of the valve housing 30 is a valve-shaft bore 52 for accommodating a valve shaft, as described below.

Figure 3:
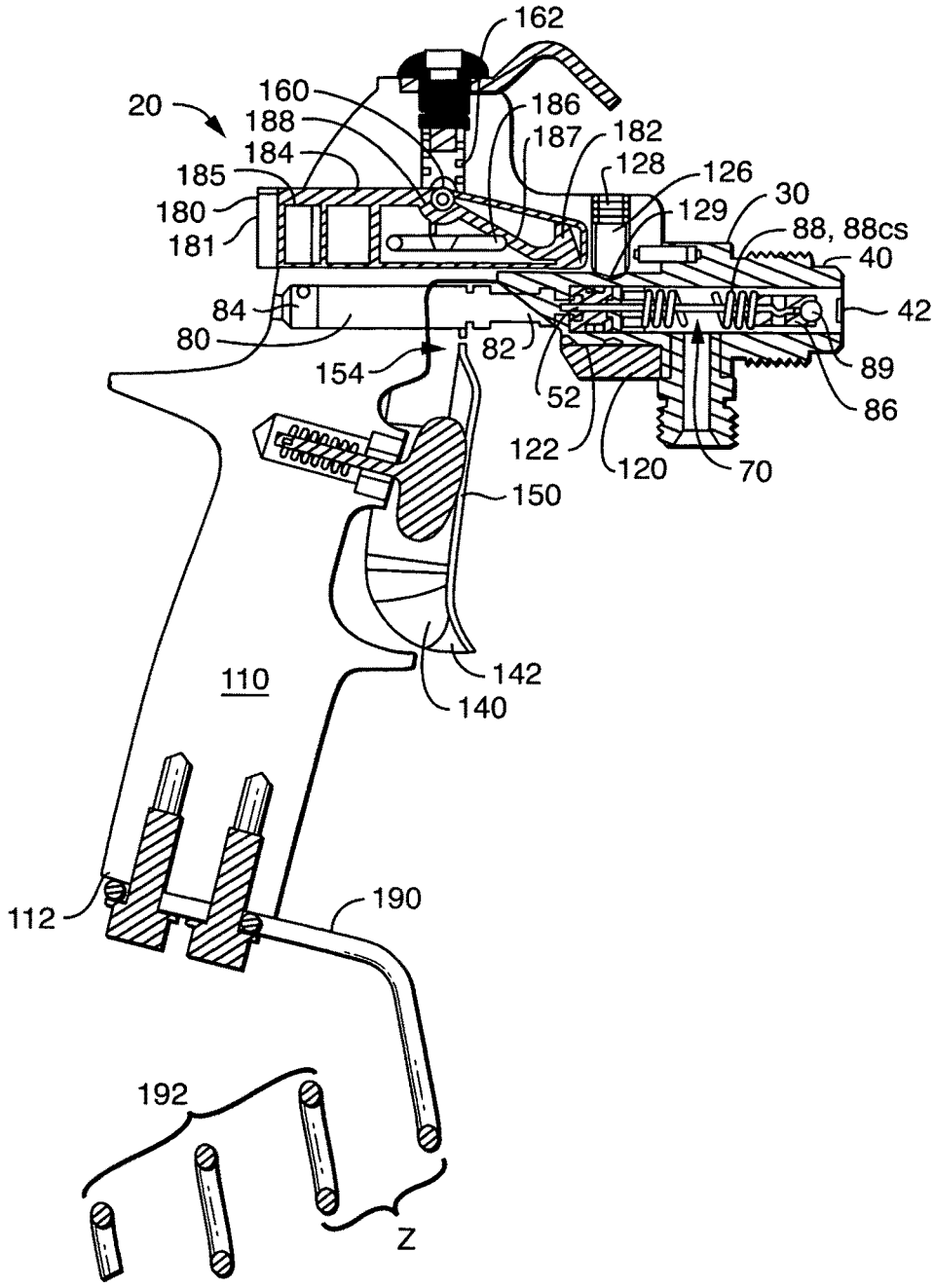
FIG. 3 is a right-side cross-sectional view of the illustrative sprayer of FIGS. 1 and 2 in which some of the internal components are depicted.
Figure 4:
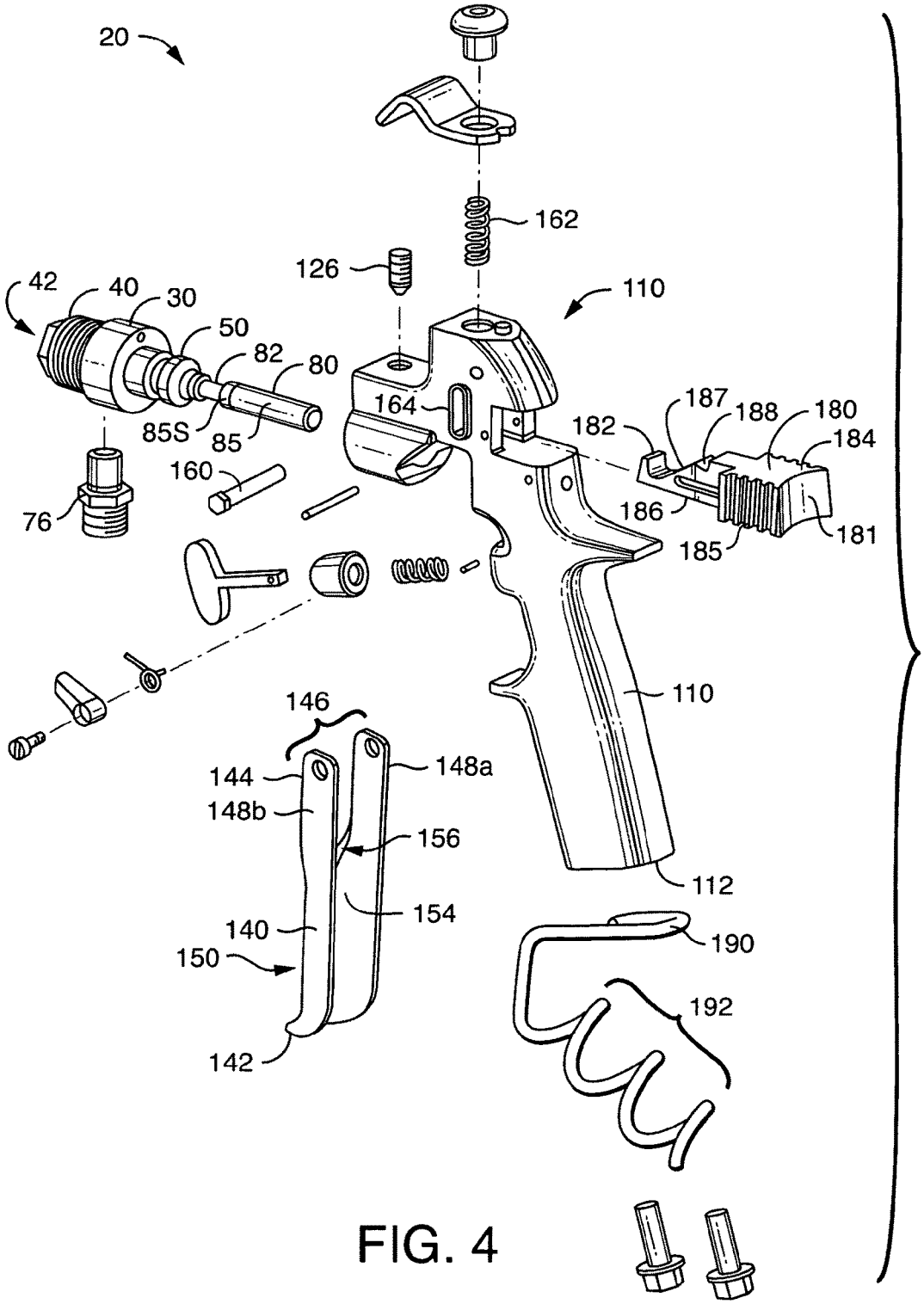
FIG. 4 is a left-rear exploded view of the coatings sprayer of FIGS. 1-3.

Referring principally to FIGS. 2 and 3, the valve housing 30 supports a valve 80. The valve 80 includes an elongated valve shaft 82 with a back end 84 and a nozzle-closing front end 86 opposite the back end 84. The valve shaft 82 extends along a valve-shaft axis $A_{VS}$ through the valve-shaft bore 52 in the rear end 50 of the valve housing 30. The valve shaft 82 is sealably supported within the valve-shaft bore 52 for fluid-tight axial reciprocation with respect to the valve housing 30 such that the front end 86 is disposed within the fluid passage 70 and the back end 84 is situated rearwardly of the rear end 50 of the valve housing 30. The seal between the valve shaft 82 and the portion of the valve housing 30 defining the valve-shaft bore 52 may accomplished by a packing gland, a device known to those of ordinary skill in the art to which the present invention pertains and, therefore, not shown.

The valve shaft 82 is normally biased toward a nozzle-closing position in which the nozzle-closing end 86 seals the nozzle orifice 42 such that fluid introduced through the fluid-supply opening 72 into the fluid passage 70 is prevented from exiting through the nozzle orifice 42. The valve shaft 82 is biased forwardly toward the nozzle-closing position by a biasing element 88 such as, by way of non-limiting example, a coiled spring $\mathbf{88}_{CS}$ retained within the valve housing 30 and helically disposed about a portion of the valve shaft 82. As mentioned in the summary, the nozzle-closing end 86 of the valve shaft 82 can be alternatively configured. However, the valve configuration is not of particular relevance to the present invention. Accordingly, for purposes of non-limiting, illustrative example, the valve 80 shown in the cross-sectional view of FIG. 3 includes a valve shaft 82 that selectively urges an orifice-sealing element 89 (e.g. a ball) against the portion of the valve housing 30 defining the nozzle orifice 42 in order to close the orifice 42.

In one embodiment, the trigger body 100 comprises a handle 110 configured for grasping by a human hand (not shown). A barrel 120 depends forwardly from the handle and includes a housing-retaining bore 122 that is configured for selectively receiving and retaining a rearward housing portion 54 that extends along a portion of the length of the valve housing 30 including the rear end 50 of the valve housing 30. In the version variously depicted in the drawings, the housing-retaining bore 122 and the rearward housing portion 54 are cylindrical in cross-section. The barrel 120 carries a catch 126 mechanically biased radially inwardly toward the housing-retaining bore 122 by a catch-spring 128. Although the catch 126 can be variously configured, the illustrative version depicted in the cross-sectional view of FIG. 3 is cylindrical with a hemispherical tip 129. As shown in FIGS. 2 and 3, the outer surface 55 of the rearward housing portion 54 has defined therein a catch-receiving recess 56 for receiving the tip 129 of the spring-loaded catch 126. In the version depicted, the recess 56 is an endless annular recess disposed about the outer surface 55 of the rearward housing portion 54. This latter feature obviates the need for a specific relative angular alignment between the valve housing 30 and the trigger body 100 as they are selectively coupled and, furthermore, permits rotation of the valve housing 30 with respect to the trigger body 100 when the rearward housing portion 54 is retained by the barrel 120.

With continued reference to FIGS. 1-4, the trigger body 100 further includes a lever in the form of a trigger 140 situated forwardly of the handle 110. The trigger 140 includes a lower trigger end 142 and an upper trigger end 144 defining a yoke 146 with transversely spaced apart first and second yoke fingers 148*a* and 148*b*. A trigger-pivot pin 160 passing through the trigger body and each of the yoke fingers 148*a* and 148*b* retains the trigger 140 for pivotable movement relative to the handle 110. The trigger 140 further includes a forward-facing finger-engaging trigger surface 150 and an opposed, rearward-facing valve-engaging surface 154. The surfaces 150 and 154 extend below the yoke fingers 148*a* and 148*b* to the lower trigger end 142 and transversely between the yoke fingers 148*a* and 148*b*. Defined through the finger-engaging and valve-engaging surfaces 150 and 154 is a valve-shaft notch 156 that communicates with, but is narrower than, the space between the yoke fingers 148*a* and 148*b*, and extends downwardly toward the lower trigger end 142.

Referring to FIG. 2, the trigger-pivot pin 160 is retained within an elongated pin slot 164 defined in the trigger body 100. The pin slot 164 enables selective lineal displacement of the pin 160 and trigger 140 in a direction including a component of spatial extension orthogonal to the valve-shaft axis $A_{VS}$ when the valve-housing 30 is cooperatively coupled with the trigger body 100. The pin 160 and trigger 140 are lineally displaceable between upper and lower trigger positions $P_{TU}$ and $P_{TL}$ as shown in, respectively, FIGS. 1 and 2. The upper trigger position $P_{TU}$ is defined such that, when the valve housing 30 is cooperatively coupled with the trigger body 100 (i.e., the rearward housing portion 54 is retained by the barrel 120), the valve shaft 82 extends through the valve-shaft notch 156 such that the back end 84 of the valve shaft 82 is situated behind the valve-engaging surface 154. A portion of the length of the valve shaft 82 situated behind the trigger 140 is of enlarged cross section relative to the portion of the length of the valve shaft 82 passing through the valve-shaft notch 156. The enlarged valve-shaft portion 85 is sufficiently large along a least one transverse dimension orthogonal to the valve-shaft axis $A_{VS}$ that it defines a shaft shoulder 85S that cannot pass through the valve-shaft notch 156 in the trigger 140. Accordingly, as the trigger 140 is pivoted rearwardly toward the handle 110 by a user's fingers, the valve-engaging surface 154 can selectively engage the shaft shoulder 85S of the enlarged valve-shaft portion, and the valve shaft 82 can be pulled rearwardly by the trigger 140 in order to open the nozzle orifice 42. It is to be understood that the valve shaft 82 could comprise more than a single piece and that, for example, the enlarged valve-shaft portion 85 defining the shaft shoulder 85S could be comprised of a separate piece (e.g., a nut, sleeve or cap) threaded onto a thinner shaft component.

Referring to FIG. 2, when removal from, or insertion into, the trigger body 100 of a valve housing 30 is desired, the trigger 140 and pin 160 are displaced toward the lower trigger position $P_{TL}$. The lower trigger position $P_{TL}$ is such that the enlarged valve-shaft portion 85 can clear the trigger 140. That is, the enlarged valve-shaft portion 85 can pass between the yoke fingers 148*a* and 148*b* unobstructed by trigger material defining the valve-shaft notch 156, thereby facilitating insertion and removal of the valve housing 30. Conversely, in operation, the trigger 140 and pin 160 are retained in an upper trigger position $P_{TU}$, such as the position shown in FIG. 1. In order to retain the trigger 140 and pin 160 in an upper trigger position $P_{TU}$, the trigger body 100 carriers a cam bolt 180 that is selectively displaceable between a first bolt position $P_{B1}$ and a second bolt position $P_{B2}$ as depicted in, respectively, FIGS. 1 and 2. With additional reference to the cross-sectional view of FIG. 3 and the exploded view of FIG. 4, the cam bolt 180 includes opposed first end and second bolt ends 181 and 182. Extending along a portion of the length of the cam bolt 180 from the first end 181 is a bolt actuator 184 including gripping surfaces 185 configured for gripping by (e.g., squeezing between) a user's fingers (not shown). Situated between the bolt actuator 184 and the second bolt end 182 is a wedge-shaped portion 186 with a sloped pin-engaging surface 187.

The wedge-shaped portion 186 interacts with the trigger-pivot pin 160 such that, as the cam bolt 180 is axially displaced toward the first bolt position $P_{B1}$, the trigger-pivot pin 160 rides along the sloped pin-engaging surface 187 and the pin 160 and trigger 140 are displaced toward the upper trigger position $P_{TU}$. Conversely, as the cam bolt 180 is displaced toward the second bolt position $P_{B1}$, the pin 160 and trigger 140 are free to displace toward the lower trigger position $P_{TL}$. In order to selectively retain the pin 160 and trigger 140 in the upper trigger position $P_{TU}$, and the cam bolt 180 in the corresponding first bolt position $P_{B1}$, the cam bolt 180 includes a pin cradle 188 in which the trigger-pivot pin 160 is seated when the pin 160 and trigger 140 are in an upper trigger position $P_{TU}$. More specifically, as the cam bolt 180 is displaced toward the first bolt position $P_{B1}$, the trigger-pivot pin 160 rides along the sloped pin-engaging surface 187 until the pin 160 reaches an uppermost position. The pin cradle 188 is situated between the portion of the sloped pin-engaging surface 187 defining the uppermost trigger position and the bolt actuator 184 such that, as the cam bolt 180 is displaced all the way toward the first bolt position $P_{B1}$, the pin 160 sets into the pin cradle 188.

As perhaps FIG. 3 illustrates most clearly, the seating of the trigger-pivot pin 160 in the pin cradle 188 acts to prevent unintended displacement of the cam bolt 180 toward the second bolt position $P_{B2}$, and associated displacement of the trigger 140 and trigger-pivot pin 160 to a lower trigger position $P_{TL}$. In order to enhance the interactive functionality of the cam bolt 180 and trigger-pivot pin 160, each of various versions includes a pin-biasing element 162 that normally biases the trigger-pivot pin 160 toward a lower trigger position $P_{TL}$. Among other functions, the pin-biasing element 162 acts to provide resistance against the movement of the trigger-pivot pin 160 from a seated position in the pin cradle 188. The pin-biasing element 162 provides a biasing force sufficiently large in magnitude to prevent the unintentional unseating of the pin 160 from the pin cradle 188 in normal use, but sufficiently small in magnitude that the pin 160 can be intentionally unseated by a user's gripping the gripping surfaces 185 and urging of the cam bolt 180 toward the second bolt position $P_{B2}$.

Referring again to FIG. 1, various versions include a hose retainer 190 that depends downwardly from the butt end 112 of the handle 110. The hose retainer 190 shown in FIG. 1 comprises a rigid material such as metal wound to define a helical guide 192. Retainers similar to hose retainer 190 are known to those skilled in the relevant arts. However, such retainers have heretofore been too tightly wound to permit a hose of typical diameter to be removed from the helix, except axially through the helix. Accordingly, in order to remove a paint-supply hose from a helical hose retainer constructed in accordance with previous specifications, a user is required to decouple the hose from the conduit coupling by which the hose is linked to the spray gun. Such decoupling requires depressurization of the system that supplies the pressurized coating material. Distinguishably, in various versions of the present invention, the pitch z of the helical guide 192 is defined such that a coating-supply hose 74*h* of a specified maximum outer hose diameter $D_{OH}$ can be removed from the helical guide 192 by "winding" it out of the helix. This will typically mean that the pitch z is at least as large as the outer hose diameter $D_{OH}$, but will usually be larger in order to account for factors that indicate a larger pitch z, such as, for example, the rigidity of the material from which the hose 74*h* is fabricated. Because the hose 74*h* can be freed from the helical guide 192 without disconnecting the valve housing 30 from the hose 74*h*, trigger body 100 can be readily coupled to another valve housing 30 linked, for example, to another color of paint or, the valve housing 30 that has been decoupled from the trigger body 100 can be readily coupled to another hand-held trigger body 100 or an alternative valve-actuating assembly such as the illustrative pole-mounted actuator head 300 discussed and described below in conjunction FIGS. 5 through 7.

Figure 5:
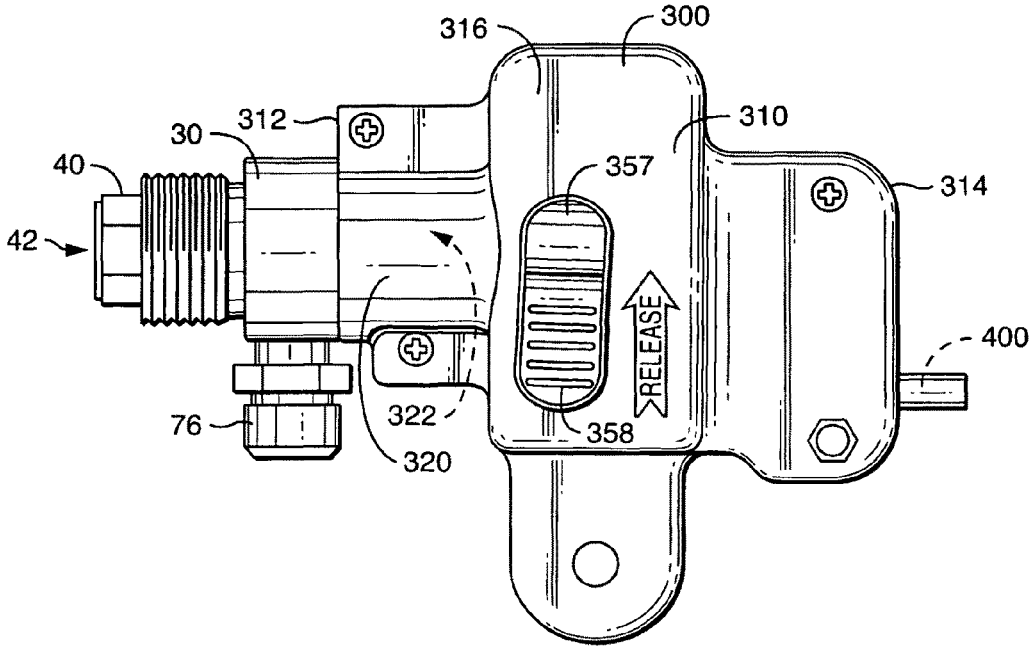
FIG. 5 is a left-side view of an alternative coatings-sprayer assembly including a pole-mountable actuator head configured for cooperatively receiving a valve housing, such as that of FIGS. 1-4, and selectively actuating the valve retained by the valve housing.
Figure 5A:
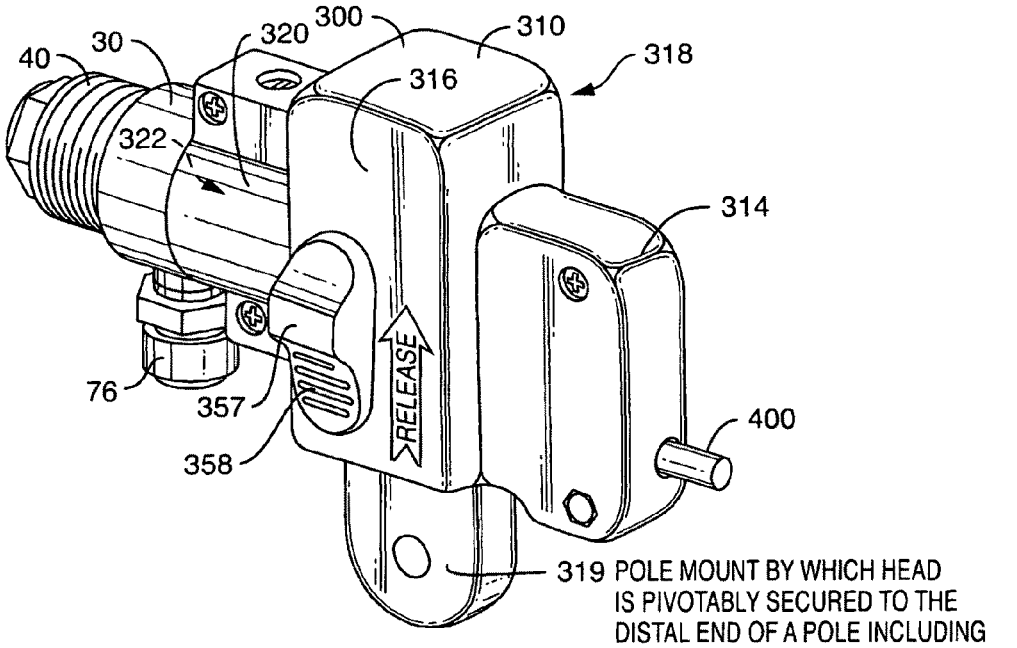
FIG. 5A is a left-rear view of the actuator head shown in FIG. 5.
Figure 6:
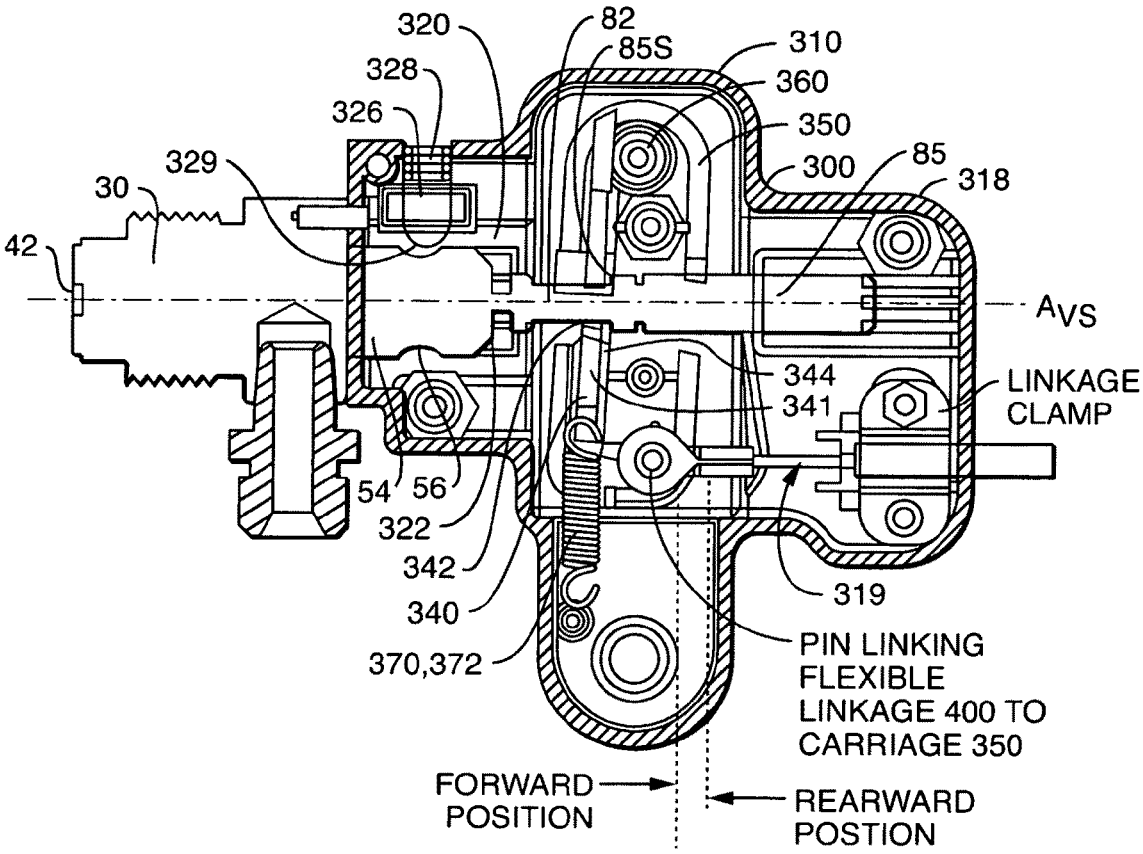
FIG. 6 is a left-side cross-sectional view of the illustrative head and valve housing of FIGS. 5 and 5A in which selected internal components are depicted.
Figure 7:
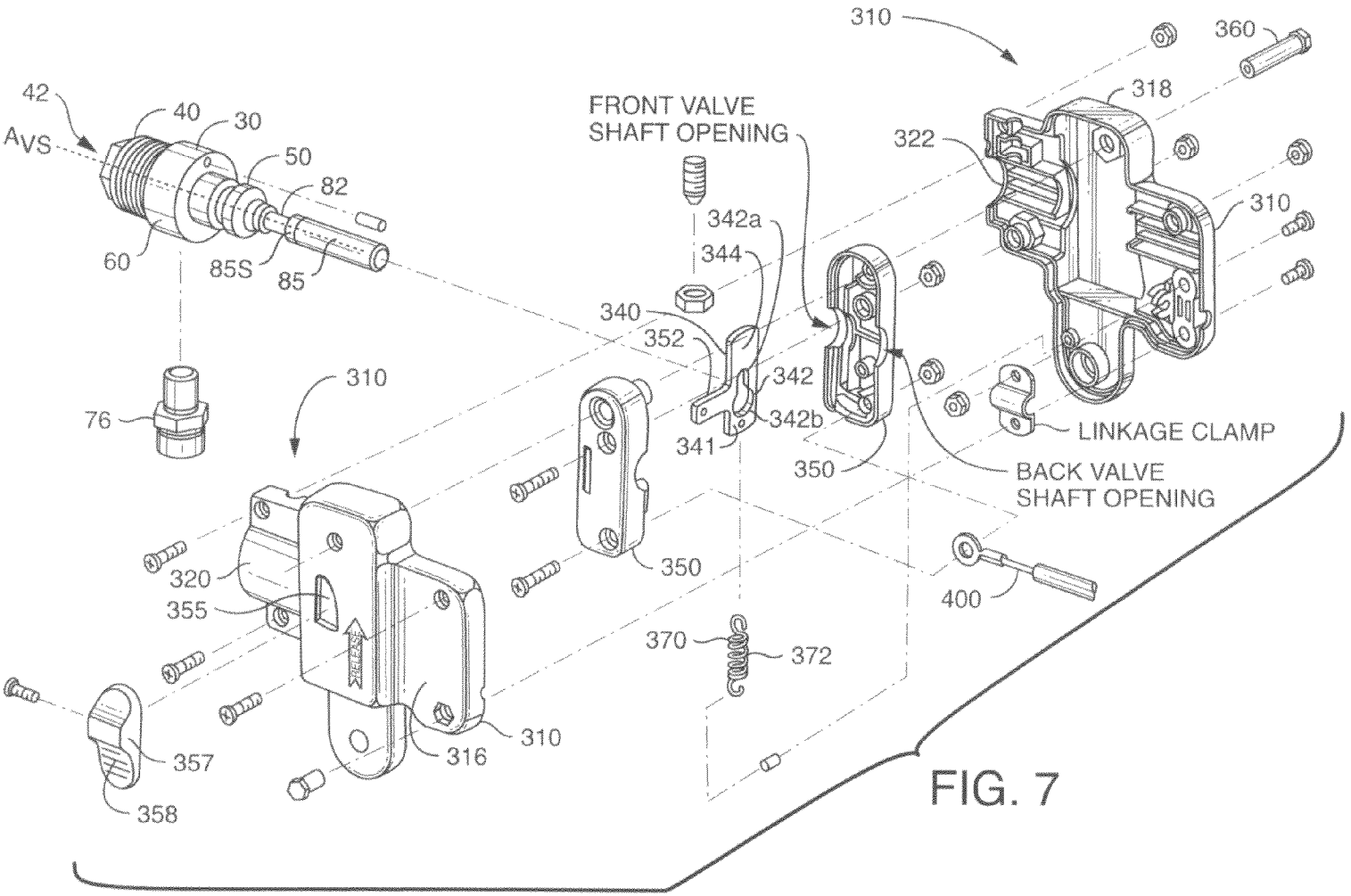
FIG. 7 is a left-rear exploded view of the coatings sprayer assembly of FIGS. 5 through 6.

The actuator head 300 shown in FIGS. 5 through 7 is configured for mounting to an extension pole (not shown) in order to facilitate reach to high places that are to be coated. With initial reference to the exterior views of FIGS. 5 and 5A, the actuator head 300 includes a body in the form of a head housing 310 with front and rear ends 312 and 314 and left and right sides 316 and 318. The heading housing 310 further includes a pole mount 319 by which the head housing 310 can be secured to the distal end of an extension pole that includes a trigger at a proximal pole end opposite the distal end. An illustrative extension pole is not shown because illustration of the same is not necessary to the comprehension of the invention by one of ordinary skill in the art to which the invention pertains. In various versions, the mechanisms by which the pole mount 319 is secured to the distal end of an extension pole are such that the heading housing 310 can pivot with respect to the extension pole.

A barrel 320 defined within the head housing 310 includes a housing-retaining bore 322 that is open to the front end 312 of the head housing 310 and is configured for selectively receiving and retaining the rearward housing portion 54 previously described in connection with the illustrative trigger body 100. In the version variously depicted in the drawings, the housing-retaining bore 322 and the rearward housing portion 54 are cylindrical in cross-section. The barrel 320 carries a catch 326 analogous to the catch 126 discussed in association with trigger body 100. The catch 326 is mechanically biased radially inwardly toward the housing-retaining bore 322 by a catch-spring 328. Although the catch 326 can be variously configured, the illustrative version depicted in the cross-sectional view of FIG. 6 is cylindrical with a hemispherical tip 329. As discussed in conjunction with FIG. 3, the outer surface 55 of the rearward housing portion 54 has defined therein a catch-receiving recess 56. The catch-receiving recess 56 is configured for receiving the tip 329 of the spring-loaded catch 326 in a manner similar to which the recess 56 is shown to have received tip 129 of the spring-loaded catch 126 in FIG. 3. When the recess 56 is an endless annular recess disposed about the outer surface 55 of the rearward housing portion 54, as in FIGS. 3 and 6, there is no need for a specific relative angular alignment between the valve housing 30 and the actuator head 300 as they are selectively coupled. Moreover, an endless annular recess 56 permits rotation of the valve housing 30 with respect to the actuator head 300 when the rearward housing portion 54 is retained within the barrel 320.

With continued reference to the interior view of FIG. 6 and, additionally, to the exploded view of FIG. 7, the actuator head 300 further includes a valve-shaft lever 340. The valve-shaft lever 340 is mounted within the head housing 310 for pivotable displacement, relative to the head housing 310, between a forward position (shown in FIG. 6) and a backward position (indicated by arrow in FIG. 6). In various versions, the lever 340 is retained by a lever carriage which, in the illustrative version depicted in FIGS. 6 and 7, is in the form of a lever casing 350. In actuality, while the indications of to the forward and backward positions shown in FIG. 6 are intended to indicate an illustrative displacement of the lever 340, they are labeled with reference to the lever casing 350, rather than the lever 340 itself, in order to obviate crowding in the drawing. The lever carriage (i.e., casing 350) is itself pivotably mounted via a lever-pivot pin 360 within and to the head housing 310, thereby rendering the valve-shaft lever 340 pivotably mounted within the head housing 310. The lever 340 further includes a lever wall 341 having defined through a portion thereof a keyed valve-shaft opening 342 with a first opening portion 342*a* and a second opening portion 342*b* larger (e.g., wider) than the first opening portion 342*a*. The lever wall 341 further includes a rearward-facing valve-engaging surface 344, the purpose of which is explained in greater detail below.

Referring still to FIGS. 6 and 7, when the valve-housing 30 is cooperatively coupled with the actuator head 300, the valve shaft 82 extends through the keyed valve-shaft opening 342, and front and back valve-shaft openings (not labeled) in the casing 350, such that the back end 84 of the valve shaft 82 is situated behind the valve-engaging surface 344. A portion of the length of the valve shaft 82 situated behind the valve-engaging surface 344 is of enlarged cross section relative to the portion of the length of the valve shaft 82 passing through the keyed valve-shaft opening 342. The enlarged valve-shaft portion 85 is sufficiently large along at least one dimension orthogonal to the valve-shaft axis $A_{VS}$ that it defines a shoulder 85S that cannot pass through the smaller, first opening portion 342*a* of the keyed valve-shaft opening 342.

The forward position of the lever 340 is such that the valve-shaft 82 (see FIG. 3) is in a nozzle-closing position in which the nozzle-closing end 86 seals the nozzle orifice 42 in the front end 40 of the valve housing 30. As the lever 340 is pivoted rearwardly toward its backward position, the valve-engaging surface 344 engages the shaft shoulder 85S of the enlarged valve-shaft portion, and the valve shaft 82 is displaced rearwardly by the lever 340 in order to open the nozzle orifice 42.

In order to enable displacement of the lever 340 toward the backward position by to remotely situated mechanisms including, for instance, a trigger located near the proximal end of an extension pole, the lever 340 is linked to an elongated flexible linkage 400. In the version of FIGS. 6 and 7, the lever 340 is not directly coupled to flexible linkage 400; instead, the casing 350 in which the lever 340 is retained is coupled to flexible linkage 400. In order to facilitate selective removal from, or insertion into, the actuator head 300 of a valve housing 30, the lever 340 can be lineally displaced in a direction having a component of spatial extension orthogonal to the valve-shaft axis $A_{VS}$ in order to accommodate passage of the enlarged valve-shaft portion 85 through the larger, second opening portion 342*b* of the keyed valve-shaft opening 342. More specifically, the lever 340 is carried by the lever carriage 350 such that it can be lineally displaced, with respect to the carriage 350, between opposed first and second lineal positions. In FIG. 6, the lever 340 is shown in a first lineal position. A first lineal position is defined such that the first opening portion 342*a* in the lever 340 is sufficiently aligned with the shaft shoulder 85S that the valve shaft 82 cannot be axially displaced through the valve-shaft opening 342 in the lever 340 and, consequently, such that, as the lever 340 is pivoted toward the backward position, the valve-engaging surface 344 engages the shaft shoulder 85S, and the valve shaft 82 is displaced rearwardly in order to open the nozzle orifice 42. A second lineal position is defined such that the shaft shoulder 85Scan be axially displaced through the larger, second opening portion 342*b* of the keyed valve-shaft opening 342, thereby facilitating selective removal from, or insertion into, the actuator head 300 of the valve housing 30.

In various versions, the lever 340 is normally biased toward both the forward pivot position and the first lineal position. To this end, the illustrative version of FIGS. 6 and 7 includes a single lever-biasing element 370 that serves both biasing functions. In the version depicted, the lever-biasing element 370 is in the form of a coiled spring 372 coupled to the housing head 310 and lever 340 so as to provide a contractive restorative force toward the first lineal position (downward, in this case) when the lever 340 is urged, by an external force, toward the second lineal position (upward, in this case). The spring 372 is furthermore aligned with respect to the lever 340 such that the helical portion thereof is more "on-axis" when the lever 340 is in the forward pivot position than when the lever 340 is in the backward pivot position. It will be appreciated that the tendency of the coiled spring 372 toward an attitude in which the helix thereof extends along a straight axis biases the lever 340 toward the forward pivot position. It will also be appreciated that the biasing functions described above can be provided by alternative, and even separate, biasing elements 370 and the example of a single coiled spring 372 is illustrative in nature and in no way limits the invention as defined in the appended claims.

In order to facilitate the selective displacement of the lever 340 into the second lineal position for selective removal from, or insertion into, the actuator head 300 of a valve housing 30, a post 352 mechanically links the lever 340 to the exterior of the housing head 310 so that a user can manually displace the lever 340. In the illustrative version of FIGS. 5 through 7, the post depends from the lever 340 and extends laterally through a post opening 355 in one side of the housing head 310. Moreover, in the version of FIGS. 5 through 7, the end of the post 350 extending to the exterior of the housing head 310 is a lever button 357 including a fingering-engaging surface 358.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A modular coatings sprayer configured for applying pressurized fluid coatings to a surface and comprising:

a valve housing having (a) a front end in which there is defined a nozzle orifice, (b) a rear end opposite the front end and through which there is defined a valve-shaft bore for supporting a valve shaft, (c) a housing side wall extending between the front and rear ends and defining an internal fluid passage, and (d) a fluid-supply opening in the housing side wall through which pressurized fluid can be introduced into the internal fluid passage;

a valve having an elongated valve shaft with a back end and a nozzle-closing front end opposite the back end, wherein (i) the valve shaft extends along a valve-shaft axis and is sealably supported within the valve-shaft bore for fluid-tight axial reciprocation relative to the valve housing, (ii) the nozzle-closing end is situated with the internal fluid passage and the back end is situated rearwardly of the rear end of the valve housing, and (iii) the valve shaft is normally biased toward a forward, nozzle-closing position in which the nozzle-closing end seals the nozzle orifice such that pressurized fluid introduced through the fluid-supply opening into the fluid passage is prevented from exiting through the nozzle orifice; and a valve-actuating assembly configured for selective cooperative coupling to, and separation from, the valve housing, and comprising:

a body; and a lever mounted, relative to the body, for pivotable movement and lineal displacement between operative and non-operative lineal positions, and including a valve-engaging surface that, when in an operative position, selectively engages a portion of the valve shaft external to the valve housing such that (i) when the lever is pivoted in a first direction, the valve shaft is displaced rearwardly in order to open the nozzle orifice and (ii) when the lever is pivoted in a second direction, opposite the first direction, the valve shaft is displaced forwardly toward the nozzle-closing position.

2. The modular coatings sprayer of claim 1 wherein (a) the valve-actuating assembly comprises a trigger body having (i) a handle configured for grasping by a human hand and (ii) a barrel extending forwardly of the handle and configured for selectively receiving and retaining a portion of the length of the valve housing, and (b) the lever is a trigger disposed forwardly of the handle and retained for pivotable movement and lineal displacement, relative to the handle, by a trigger-pivot pin.

3. The modular coatings sprayer of claim 2 wherein (i) the fluid-supply opening can be selectively coupled with, and decoupled from, a fluid-supply conduit that is connected to a reservoir of pressurized fluid coating material and (ii) when the fluid-supply opening is coupled to a reservoir of pressurized coating material, the trigger body and valve housing can be mutually coupled and decoupled without depressurizing the fluid connection between the reservoir and the internal fluid passage defined within the valve housing.

4. The modular coatings sprayer of claim 3 wherein (a) the trigger includes (i) a lower trigger end, (ii) an upper trigger end defining a yoke with transversely spaced apart first and second yoke fingers through which the trigger-pivot pin passes in order to retain the trigger, (iii) a finger-engaging surface extending transversely between the fingers and including a valve-shaft notch that extends toward the lower trigger end and is narrower than the distance between the yoke fingers, and (iv) a valve-engaging surface opposite the finger-engaging surface;

(b) the trigger-pivot pin is retained within an elongated pin slot defined in the trigger body in order to facilitate selective lineal displacement of the pin and trigger between upper and lower trigger positions;

(c) the valve shaft includes an enlarged valve-shaft portion sufficiently large along at least one dimension that it defines a shaft shoulder that cannot pass through the valve-shaft notch;

(d) the upper trigger position is an operative position such that (i) when the valve housing and trigger body are cooperatively coupled, a portion of the length of the valve shaft passes through the valve-shaft notch and the enlarged valve-shaft portion is situated behind the trigger, and (ii) rearward pivoting of the trigger toward the handle causes the valve-engaging surface to engage the shaft shoulder and displace the valve shaft in order to open the nozzle orifice; and (e) the lower trigger position is a non-operative position such that the enlarged shaft portion can pass between the yoke fingers, thereby facilitating alternative insertion and removal of the valve housing from the trigger body.

5. The modular coatings sprayer of claim 1 wherein (i) the fluid-supply opening can be selectively coupled with, and decoupled from, a fluid-supply conduit that is connected to a reservoir of pressurized fluid coating material and (ii) when the fluid-supply opening is coupled to a reservoir of pressurized coating material, the valve-actuating assembly and valve housing can be mutually coupled and decoupled without depressurizing the fluid connection between the reservoir and the internal fluid passage defined within the valve housing.

6. The modular coatings sprayer of claim 1 wherein the valve-actuating assembly to which the valve housing is selectively coupleable is a pole-mountable actuator head including a head housing comprising:

front and rear ends;

a pole mount by which the head housing can be secured to the distal end of an extension pole having, in addition to the distal end, a proximal end opposite the distal end and a trigger more proximate the proximal end than the distal end; and a barrel including a housing-retaining channel that is open to the front end and configured for selectively receiving and retaining a portion of the length of the valve housing; wherein (i) the lever is a valve-shaft lever mounted within the head housing for pivotable displacement, relative to the head housing, between a forwardmost position and a backward position;

(ii) the forwardmost position of the valve-shaft lever corresponds to the nozzle-closing position of the valve-shaft; and (iii) the valve-shaft lever is linked to an elongated flexible linkage that enables displacement of the valve-shaft lever toward a backward position, and the corresponding rearward displacement of the valve shaft, in order to open the nozzle orifice.

7. The modular coatings sprayer of claim 6 wherein (a) the valve-shaft lever includes a lever wall having (i) a rearward-facing valve-engaging surface and (ii) defined through a portion thereof a keyed valve-shaft opening with a first opening portion and a second opening portion larger along at least one dimension than the first opening portion;

(b) in addition to being pivotably displaceable relative to the head housing, the valve-shaft lever is mounted for selective lineal displacement, relative to the head housing, between first and second lineal positions;

(c) the valve shaft includes an enlarged valve-shaft portion sufficiently large along at least one dimension that it defines a shaft shoulder that cannot pass through the first opening portion;

(d) the first lineal position is an operative position such that (i) when the valve housing and actuator head are cooperatively coupled, a portion of the length of the valve shaft passes through the keyed valve-shaft opening and the enlarged valve-shaft portion is situated behind the valve-shaft lever, and (ii) rearward pivoting of the valve-shaft lever causes the valve-engaging surface to engage the shaft shoulder and displace the valve shaft in order to open the nozzle orifice; and (e) the second lineal position is a non-operative position such that the enlarged shaft portion can pass through the second opening portion, thereby facilitating alternative coupling and decoupling of the valve housing and the actuator head.

8. The modular coatings sprayer of claim 7 wherein (i) the fluid-supply opening can be selectively coupled with, and decoupled from, a fluid-supply conduit that is connected to a reservoir of pressurized fluid coating material and (ii) when the fluid-supply opening is coupled to a reservoir of pressurized coating material, the actuator head and valve housing can be mutually coupled and decoupled without depressurizing the fluid connection between the reservoir and the internal fluid passage defined within the valve housing.

9. The modular coatings sprayer of claim 6 wherein (i) the fluid-supply opening can be selectively coupled with, and decoupled from, a fluid-supply conduit that is connected to a reservoir of pressurized fluid coating material and (ii) when the fluid-supply opening is coupled to a reservoir of pressurized coating material, the actuator head and valve housing can be mutually coupled and decoupled without depressurizing the fluid connection between the reservoir and the internal fluid passage defined within the valve housing.

10. A modular spray gun configured for applying pressurized fluid coatings to a surface and comprising:

a valve housing having (a) a front end in which there is defined a nozzle orifice, (b) a rear end opposite the front end and through which there is defined a valve-shaft bore, (c) a housing side wall extending between the front and rear ends and defining an internal fluid passage, and (d) a fluid-supply opening in the housing side wall through which pressurized fluid can be introduced into the internal fluid passage;

a valve having an elongated valve shaft with a back end and a nozzle-closing front end opposite the back end, wherein (i) the valve shaft extends along a valve-shaft axis and is sealably supported within the valve-shaft bore for fluid-tight axial reciprocation relative to the valve housing, (ii) the nozzle-closing end is situated with the internal fluid passage and the back end is situated rearwardly of the rear end of the valve housing, and (iii) the valve shaft is normally biased toward a forward, nozzle-closing position in which the nozzle-closing end seals the nozzle orifice such that pressurized fluid introduced through the fluid-supply opening into the fluid passage is prevented from exiting through the nozzle orifice; and a trigger body configured for selective cooperative coupling to, and decoupling from, the valve housing, and comprising:

a handle; and a trigger disposed forwardly of the handle and retained by a trigger-pivot pin for pivotable movement and lineal displacement, relative to the handle, between operative and non-operative lineal positions, the trigger having a valve-engaging surface that, when in an operative position, selectively engages a portion of the valve shaft external to the valve housing such that, when the trigger is pivoted toward the handle, the valve shaft is displaced out of the nozzle-closing position in order to open the nozzle orifice.

11. The modular spray gun of claim 10 wherein (a) the trigger includes (i) a lower trigger end, (ii) an upper trigger end defining a yoke with transversely spaced apart first and second yoke fingers through which the trigger-pivot pin passes in order to retain the trigger, (iii) a finger-engaging surface extending transversely between the fingers and including a valve-shaft notch that extends toward the lower trigger end and is narrower than the distance between the yoke fingers, and (iv) a valve-engaging surface opposite the finger-engaging surface;

(b) the trigger-pivot pin is retained within an elongated pin slot defined in the trigger body in order to facilitate selective lineal displacement of the pin and trigger between upper and lower trigger positions;

(c) the valve shaft includes an enlarged valve-shaft portion sufficiently large along at least one dimension that it defines a shaft shoulder that cannot pass through the valve-shaft notch;

(d) the upper trigger position is an operative position such that (i) when the valve housing and trigger body are cooperatively coupled, a portion of the length of the valve shaft passes through the valve-shaft notch and the enlarged valve-shaft portion is situated behind the trigger, and (ii) rearward pivoting of the trigger toward the handle causes the valve-engaging surface to engage the shaft shoulder and displace the valve shaft in order to open the nozzle orifice; and (e) the lower trigger position is a non-operative position such that the enlarged shaft portion can pass between the yoke fingers, thereby facilitating alternative insertion and removal of the valve housing from the trigger body.

12. The modular spray gun of claim 11 wherein (i) the fluid-supply opening can be selectively coupled with, and decoupled from, a fluid-supply conduit that is connected to a reservoir of pressurized fluid coating material and (ii) when the fluid-supply opening is coupled to a reservoir of pressurized coating material, the trigger body and valve housing can be mutually coupled and decoupled without depressurizing the fluid connection between the reservoir and the internal fluid passage defined within the valve housing.

13. The modular spray gun of claim 10 wherein (i) the fluid-supply opening can be selectively coupled with, and decoupled from, a fluid-supply conduit that is connected to a reservoir of pressurized fluid coating material and (ii) when the fluid-supply opening is coupled to a reservoir of pressurized coating material, the trigger body and valve housing can be mutually coupled and decoupled without depressurizing the fluid connection between the reservoir and the internal fluid passage defined within the valve housing.

14. A modular coatings sprayer configured for applying pressurized fluid coatings to a surface and comprising:

a valve housing having (a) a front end in which there is defined a nozzle orifice, (b) a rear end opposite the front end and through which there is defined a valve-shaft bore, (c) a housing side wall extending between the front and rear ends and defining an internal fluid passage, and (d) a fluid-supply opening in the housing side wall through which pressurized fluid can be introduced into the internal fluid passage;

a valve having an elongated valve shaft with a back end and a nozzle-closing front end opposite the back end, wherein (i) the valve shaft extends along a valve-shaft axis and is sealably supported within the valve-shaft bore for fluid-tight axial reciprocation relative to the valve housing, (ii) the nozzle-closing end is situated with the internal fluid passage and the back end is situated rearwardly of the rear end of the valve housing, and (iii) the valve shaft is normally biased toward a forward, nozzle-closing position in which the nozzle-closing end seals the nozzle orifice such that pressurized fluid introduced through the fluid-supply opening into the fluid passage is prevented from exiting through the nozzle orifice; and an actuator head having a head housing comprising:

front and rear ends;

a pole mount by which the head housing can be secured to the distal end of an extension pole having, in addition to the distal end, a proximal end opposite the distal end and a trigger more proximate the proximal end than the distal end;

a barrel including a housing-retaining channel that is open to the front end and configured for selectively receiving and retaining a portion of the length of the valve housing; and a valve-shaft lever mounted within the head housing for both selective lineal displacement, relative to the head housing, between an operative first lineal position and a non-operative second lineal position, and pivotable displacement, relative to the head housing, between a forwardmost position and a backward position, the valve-shaft lever including a valve-engaging surface that selectively engages a portion of the valve shaft external to the valve housing; wherein (i) the forwardmost position of the valve-shaft lever corresponds to the nozzle-closing position of the valve shaft; and (ii) the valve-shaft lever is linked to an elongated flexible linkage that enables displacement of the valve-shaft lever toward the backward position, and the corresponding rearward displacement of the valve shaft, in order to open the nozzle orifice.

15. The modular coatings sprayer of claim 14 wherein (a) the valve-shaft lever includes a lever wall having (i) a rearward-facing valve-engaging surface and (ii) defined through a portion thereof a keyed valve-shaft opening with a first opening portion and a second opening portion larger along at least one dimension than the first opening portion;

(b) the valve shaft includes an enlarged valve-shaft portion sufficiently large along at least one dimension that it defines a shaft shoulder that cannot pass through the first opening portion;

(c) the first lineal position is operative such that (i) when the valve housing and actuator head are cooperatively coupled, a portion of the length of the valve shaft passes through the keyed valve-shaft opening and the enlarged valve-shaft portion is situated behind the valve-shaft lever, and (ii) rearward pivoting of the valve-shaft lever causes the valve-engaging surface to engage the shaft shoulder and displace the valve shaft in order to open the nozzle orifice; and (d) the second lineal position is non-operative such that the enlarged shaft portion can pass through the second opening portion, thereby facilitating alternative coupling and decoupling of the valve housing and the actuator head.

16. The modular coatings sprayer of claim 15 wherein (i) the fluid-supply opening can be selectively coupled with, and decoupled from, a fluid-supply conduit that is connected to a reservoir of pressurized fluid coating material and (ii) when the fluid-supply opening is coupled to a reservoir of pressurized coating material, the actuator head and valve housing can be mutually coupled and decoupled without depressurizing the fluid connection between the reservoir and the internal fluid passage defined within the valve housing.

17. The modular coatings sprayer of claim 14 wherein (i) the fluid-supply opening can be selectively coupled with, and decoupled from, a fluid-supply conduit that is connected to a reservoir of pressurized fluid coating material and (ii) when the fluid-supply opening is coupled to a reservoir of pressurized coating material, the actuator head and valve housing can be mutually coupled and decoupled without depressurizing the fluid connection between the reservoir and the internal fluid passage defined within the valve housing.

* * * * *